US006540544B1

(12) United States Patent
Akeda

(10) Patent No.: US 6,540,544 B1
(45) Date of Patent: Apr. 1, 2003

(54) PRESS-CONNECTING CONNECTOR AND WIRE PRESS-FITTING APPARATUS

(75) Inventor: Nobuyuki Akeda, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/702,749

(22) Filed: Nov. 1, 2000

(30) Foreign Application Priority Data

Nov. 5, 1999 (JP) ..... 11-315393

(51) Int. Cl.[7] ..... H01R 13/40
(52) U.S. Cl. ..... 439/395; 439/404
(58) Field of Search ..... 439/395, 398, 439/400, 403, 404, 409, 410

(56) References Cited

U.S. PATENT DOCUMENTS

| | | | | |
|---|---|---|---|---|
| 5,581,879 A | | 12/1996 | Tsuji et al. | 29/861 |
| 5,694,681 A | * | 12/1997 | Hatagishi et al. | 439/395 |
| 5,827,087 A | * | 10/1998 | Yamasaki | 439/395 |
| 6,093,047 A | * | 7/2000 | Ann | 439/395 |

FOREIGN PATENT DOCUMENTS

| | | |
|---|---|---|
| JP | 4-33286 | 2/1992 |
| JP | 7-22467 | 4/1995 |
| JP | 7-240266 | 9/1995 |

* cited by examiner

*Primary Examiner*—Hien Vu
(74) *Attorney, Agent, or Firm*—Morgan, Lewis & Bockius LLP

(57) ABSTRACT

In a press-connecting connector (30), a receiving width (W2) between side walls (31*b*, 31*b*) of a connector housing (31) is larger than a width (W1) of the press-connecting portion, and a gap (g) is formed between each press-connecting blade (9) and the corresponding side wall (31*b*). In a wire press-fitting apparatus (40), a lower end surface (43*a*) of each of press-connecting blade pressing portions (43) is flat. The lower end surfaces (43*a*) of the press-connecting blade pressing portions (43) are brought into abutting engagement with upper end surfaces (9*d*) of the press-connecting blades (9), respectively, and a lower end surface (42*a*) of a press-fitting rod portion (42) forces an electric wire (7) into a gap (G) between downwardly-extending inner surfaces (9*c*, 9*c*). As a result, the pair of press-connecting blades (9) are displaced respectively toward the side walls (31*b*, 31*b*), so that the gap (G) between the downwardly-extending inner surfaces (9*c*, 9*c*) is expanded into a generally V-shape. Therefore, edges (9*b*), formed respectively along bladed, tapering guide surfaces (9*a*), can properly cut a sheath (7*a*) of the electric wire (7) without excessively cut a conductor (7*b*) of the electric wire (7).

2 Claims, 8 Drawing Sheets

PRESS-CONNECTING CONNECTOR AND WIRE PRESS-FITTING APPARATUS

BACKGROUND OF THE INVENTION

1. Field of the Invention

The present invention relates to a press-connecting connector in which an electric wire of the wiring, installed in a vehicle, can be properly press-fitted into a press-connecting terminal without cutting a conductor thereof. Further, the present invention relates to a wire press-fitting apparatus for press-fitting an electric wire into a press-connecting terminal.

The present application is based on Japanese Patent Application No. Hei. 11-315393, which is incorporated herein by reference.

2. Description of the Related Art

In vehicles having various electronic equipments mounted thereon, press-connecting connectors have been extensively used for connecting the electronic equipments together and for connecting wire harnesses together. As shown in FIG. 6, a conventional press-connecting connector 10 comprises a connector housing 11, having an insertion opening formed in its front side for receiving a mating connector, and press-connecting terminals 1. The press-connecting terminal 1 is formed by cutting and bending an electrically-conductive metal sheet.

The press-connecting terminal 1 includes a connection portion for being resiliently electrically connected to a connection terminal (not shown) in the mating connector inserted in a direction of arrow A, a press-connecting portion 4 for press-fitting an electric wire 7 thereinto in a direction of arrow B, and a clamping portion 4 having a pair of retaining piece portions 8*a* and 8*b* for press-holding the electric wire 7 through a sheath 7*a* of this wire. The press-connecting portion 4 includes three pairs of press-connecting blades 9 each pair of which cut the sheath 7*a* to press-contact and hold a conductor 7*b* of the electric wire in electrically-connected relation thereto.

As shown in FIG. 7, each pair of press-connecting blades 9 are formed respectively by cutting opposed side plates 2*a* respectively at regions 2*b* adjacent to a bottom wall 2*c* and then by bending these portions inwardly. The pair of press-connecting blades 9 have respective bladed, tapering guide surfaces 9*a* each slanting inwardly downwardly from an upper end surface 9*d*, and each bladed, tapering guide surface 9*a* has an edge 9*b* formed along its slanting surface by cutting.

The pair of press-connecting blades 9 have a pair of opposed inner surfaces 9*c* and 9*c* which extend downwardly from their respective bladed, tapering guide surfaces 9*a*, with a gap G formed therebetween, the gap G being smaller than the diameter d of the conductor 7*b* (see FIG. 6).

When the electric wire is press-fitted between the pair of press-connecting blades 9, their edges 9*b* cut the sheath 7*a* of the electric wire, while gradually compressing and deforming the outer diameter of the electric wire by their bladed, tapering guide surfaces 9*a*. When the electric wire 7 is further press-fitted, the edges 9*b* cut the sheath 7*a*.

The gap G is thus smaller than the diameter d of the conductor 7*b* (G<d), and in this case, the conductor 7*b*, comprising a stranded wire comprised of thin wires twisted together, is deformed into a vertically-spread shape by the downwardly-extending inner surfaces 9*c*, and is exposed through cut portions of the sheath 7*a*, and therefore contacts the downwardly-extending inner surfaces 9*c*.

As shown in FIG. 8, the electric wire 7 is press-fitted relative to the press-connecting blades 9 by the use of a wire press-fitting apparatus 20, and this wire press-fitting apparatus 20 broadly has the following construction. Namely, the wire press-fitting apparatus 20 comprises a vertically-movable hollow body portion 21, a press-fitting rod portion 22 which can project downwardly along an axis CL of the hollow body portion 21, and a pair of press-connecting blade pressing portions 23 resiliently suspended in an internal space 21*a* of the hollow body portion 21 through spring members 24. Each of the press-connecting blade pressing portions 23 has a stepped lower end surface 23*a* for fitting on step portions of the upper end surfaces 9*d* of the corresponding press-connecting blades 9.

In the process of moving the hollow body portion 21 downward to a lower limit in the wire press-fitting apparatus 20, first, the lower end surfaces 23*a* of the press-connecting blade pressing portions 23 are brought into contact with the upper end surfaces 9*d*, and resiliently presses these end surfaces 9*d*, thereby firmly positioning the press-connecting blades 9. Then, a lower end 22*a* of the press-fitting rod 22 forces the electric wire 7 into the gap between each pair of the opposed, downwardly-extending inner surfaces 9*c* and 9*c* via the bladed, tapering guide surfaces 9*a*.

When the electric wire 7 is gradually forced into the gap between each pair of downwardly-extending inner surfaces 9*c* and 9*c* via the bladed, tapering guide surfaces 9*a*, each pair of press-connecting blades 9 tend to be displaced away from each other respectively toward side walls 11*b* of the connector housing 11. However, the lower end surfaces 23*a* of the press-connecting blade pressing portions 23 are engaged with the upper end surfaces 9*d* of the press-connecting blades 9 at their step portions, and therefore the press-connecting blades 9 are prevented from displacement, so that the gap G between each pair of press-connecting blades 9 is kept constant.

In the above conventional press-connecting connector 10, however, there are occasions when variations in thickness of the sheath 7*a* and diameter d of the conductor 7*b* develop. In this case, when the electric wire 7 is forced into the gap G in the press-connecting terminal 1, the conductor, having a diameter larger than the predetermined diameter d, is excessively cut by the edges 9*b*. As a result, the degree of press-contact of the conductor 7*b* with the opposed, downwardly-extending inner surfaces 9*c* decreases, and an electrical resistance at the area of contact between the conductor and each downwardly-extending inner surface 9*c* increases to generate heat, so that those members around the press-connecting portion 4 are subjected to deterioration, improper contact and so on, and this has invited a problem from the viewpoint of safety of the vehicle.

SUMMARY OF THE INVENTION

It is an object of the present invention to solve the above problems of the conventional construction, and more specifically to provide a press-connecting connector in which a conductor of an electric wire can be properly press-fitted into a press-connecting portion without being excessively cut, and also to provide a wire press-fitting apparatus for use with this press-connecting connector.

To achieve the above object, according to the first aspect of the present invention, there is provided a press-connecting connector which includes:

a connector housing including a terminal receiving chamber; and a press-connecting terminal insertable into the terminal receiving chamber, the press-connecting terminal including:

a base, a connection portion, to which a terminal of a mating connector is electrically connectable, disposed on the base, and a press-connecting portion, to which a conductor of an electric wire is electrically connectable, disposed on the base, the press-connecting portion including a pair of press-connecting blades which have:

a pair of bladed, tapering guide surfaces which slant inwardly downwardly, and a pair of opposed inner surfaces, between which a gap smaller than a diameter of the conductor of the electric wire is formed, and which downwardly extend respectively from the pair of tapering guide surfaces;

wherein when the electric wire is press-fitted into the gap, the conductor of the electric wire is electrically connected to and held by the pair of press-connecting blades, wherein a receiving width between opposed side walls of the terminal receiving chamber, receiving the press-connecting portion, is larger than a width of the press-connecting portion, and wherein the pair of press-connecting blades are tilted respectively toward the opposed side walls when the electric wire is press-fitted into the gap, so that the opposed inner surfaces of the press-connecting blades are outwardly expanded into a generally V-shape.

In the press-connecting connector of the above construction, the degree of displacement of the press-connecting blades away from each other varies in accordance with the outer diameter of the electric wire, and edges, formed respectively along the bladed, tapering guide surfaces, can properly cut a sheath of the electric wire without cutting the conductor.

Further, to achieve the above object, according to the second aspect of the present invention, there is provided a wire press-fitting apparatus for press-fitting an electric wire into a press-fitting portion of a press-fitting terminal, including:

a hollow body portion which is vertically movable;

a press-fitting rod portion which can project downwardly along an axis of the hollow body portion; and a pair of pressing portions, which are operative to press a pair of press-connecting blades of a press-fitting portion of a press-fitting terminal, and which are resiliently suspended in an internal space of the hollow body portion through spring members;

wherein each of the pair of pressing portions has a flat lower end surface for pressing an upper end surface of the corresponding press-connecting blade, and wherein, in accordance with the press-fitting of the electric wire, the pair of press-connecting blades slightly push the lower end surfaces of the pressing portions back upwardly through the upper end surfaces, so that the pair of press-connecting blades are tilted respectively toward opposed side walls of a connector housing with a result that opposed inner surfaces of the press-connecting blades are outwardly expanded into a generally V-shape.

In the wire press-fitting apparatus of the above construction, the edges, formed respectively along the bladed, tapering guide surfaces, can properly cut the sheath of the electric wire without excessively cutting the conductor.

DETAILED DESCRIPTION OF THE PREFERRED EMBODIMENT

Figure 1:
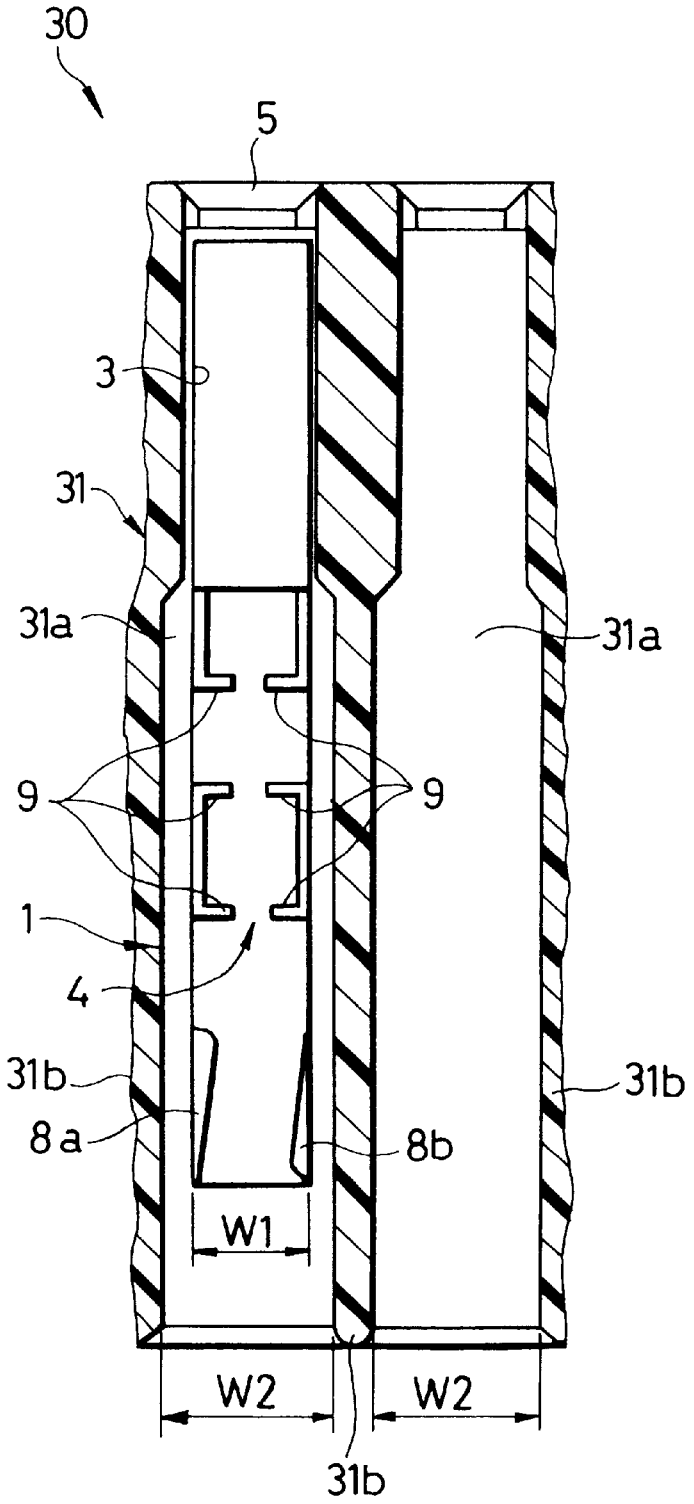
FIG. 1 is a fragmentary, cross-sectional view of an important portion of a press-connecting connector of the present invention.
Figure 2:
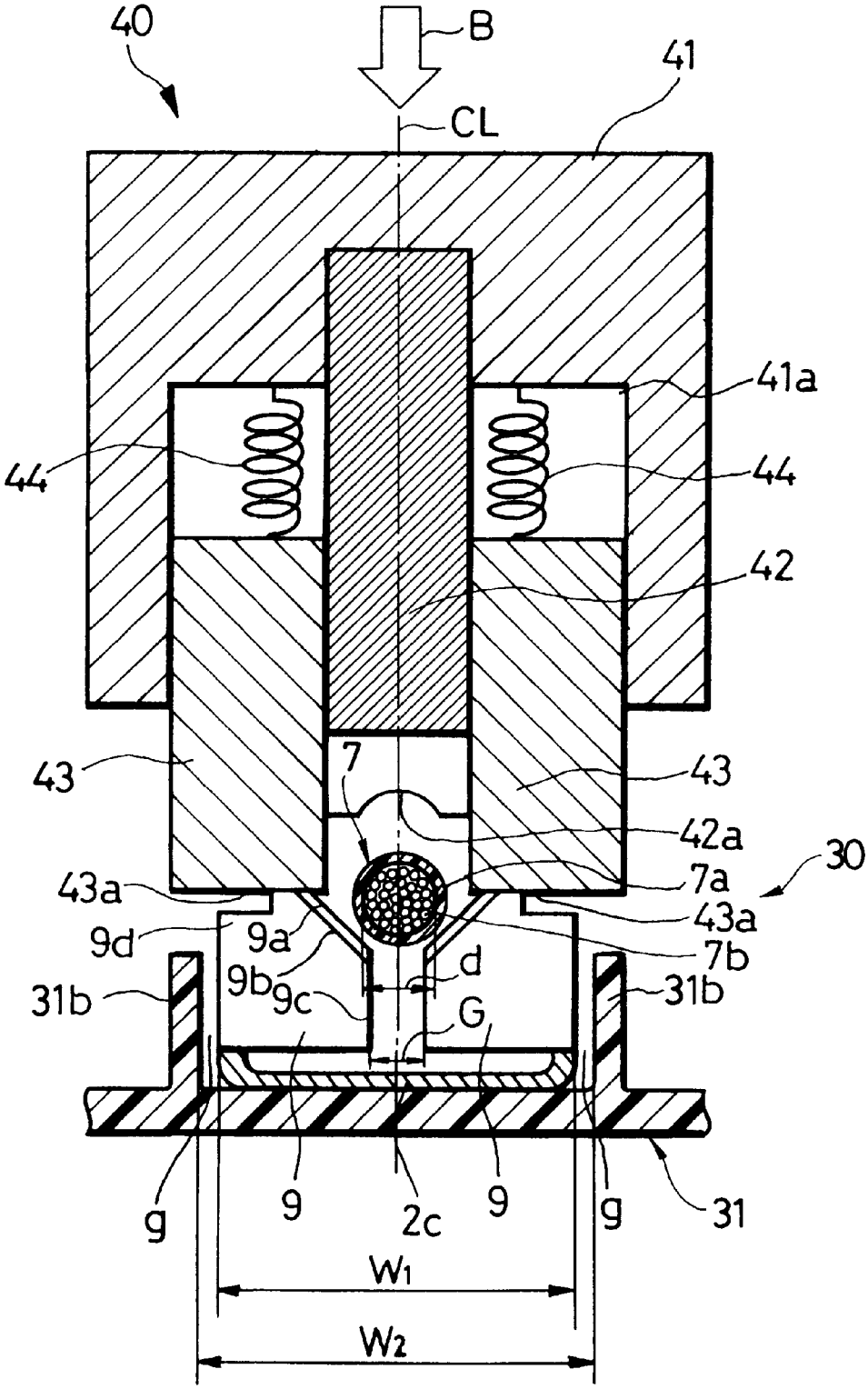
FIG. 2 is an operation-explaining view of a wire press-fitting apparatus of the present invention.
Figure 3:
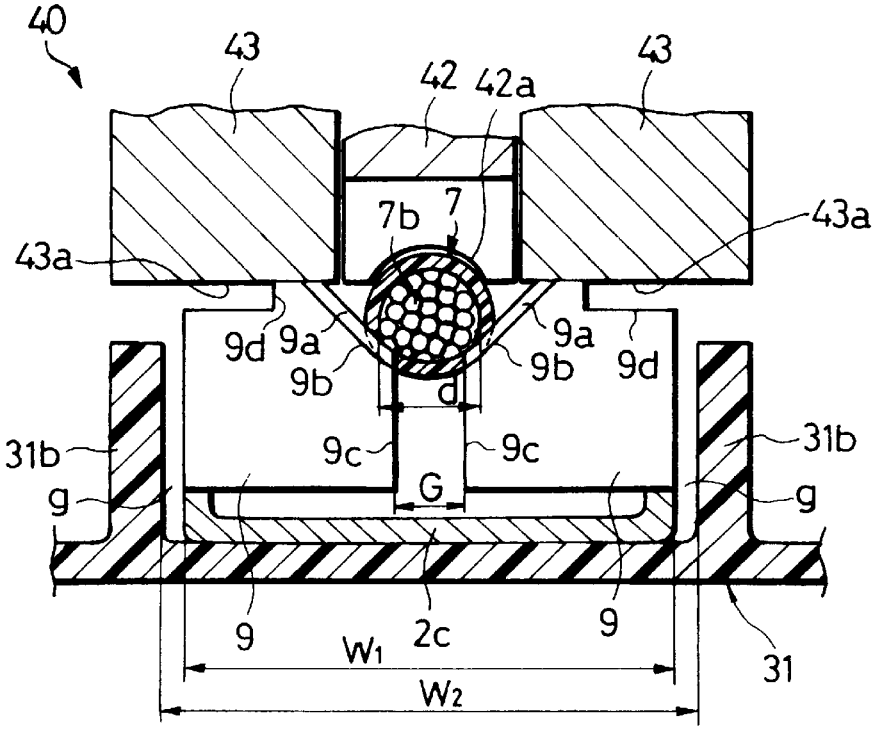
FIG. 3 is a an operation-explaining view showing an initial stage of a wire press-fitting operation effected by the wire press-fitting apparatus of FIG. 2.
Figure 4:
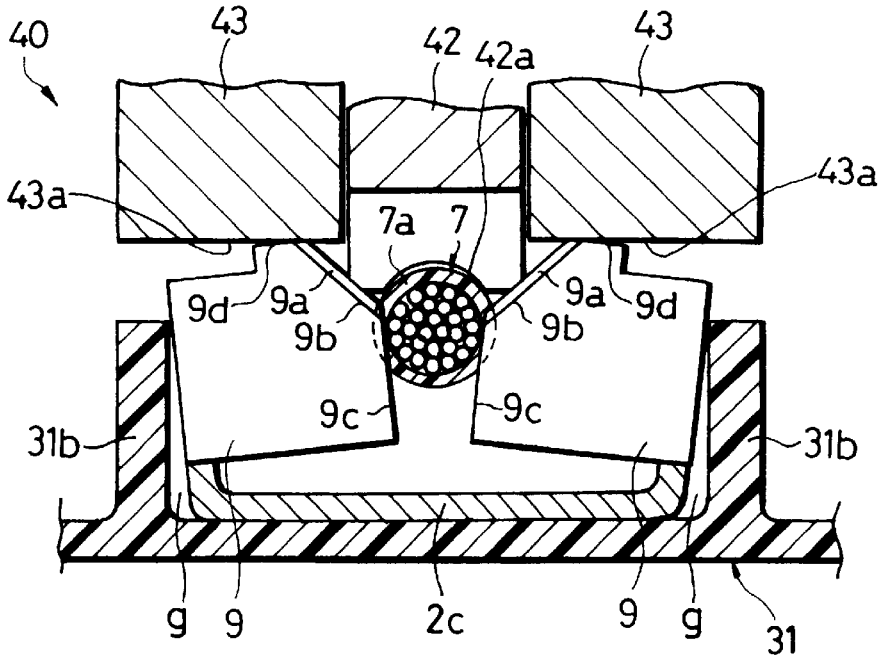
FIG. 4 is an operation-explaining view showing an intermediate stage of the wire press-fitting operation in FIG. 3.
Figure 5:
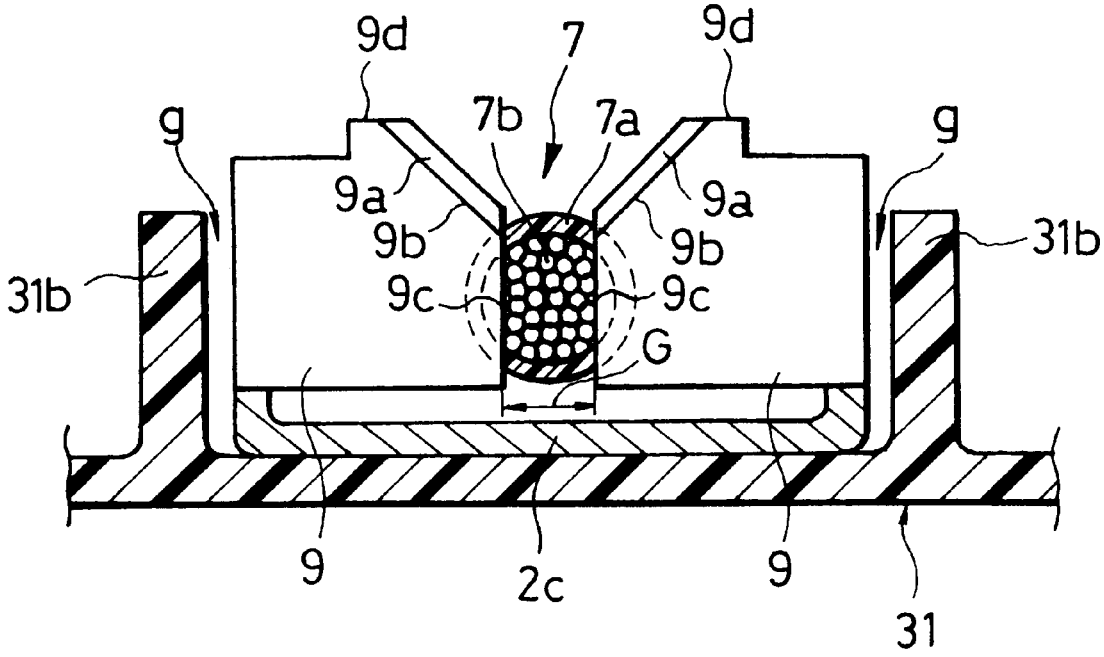
FIG. 5 is an operation-explaining view showing a condition in which the wire press-fitting operation in FIG. 4 is completed.
Figure 6:
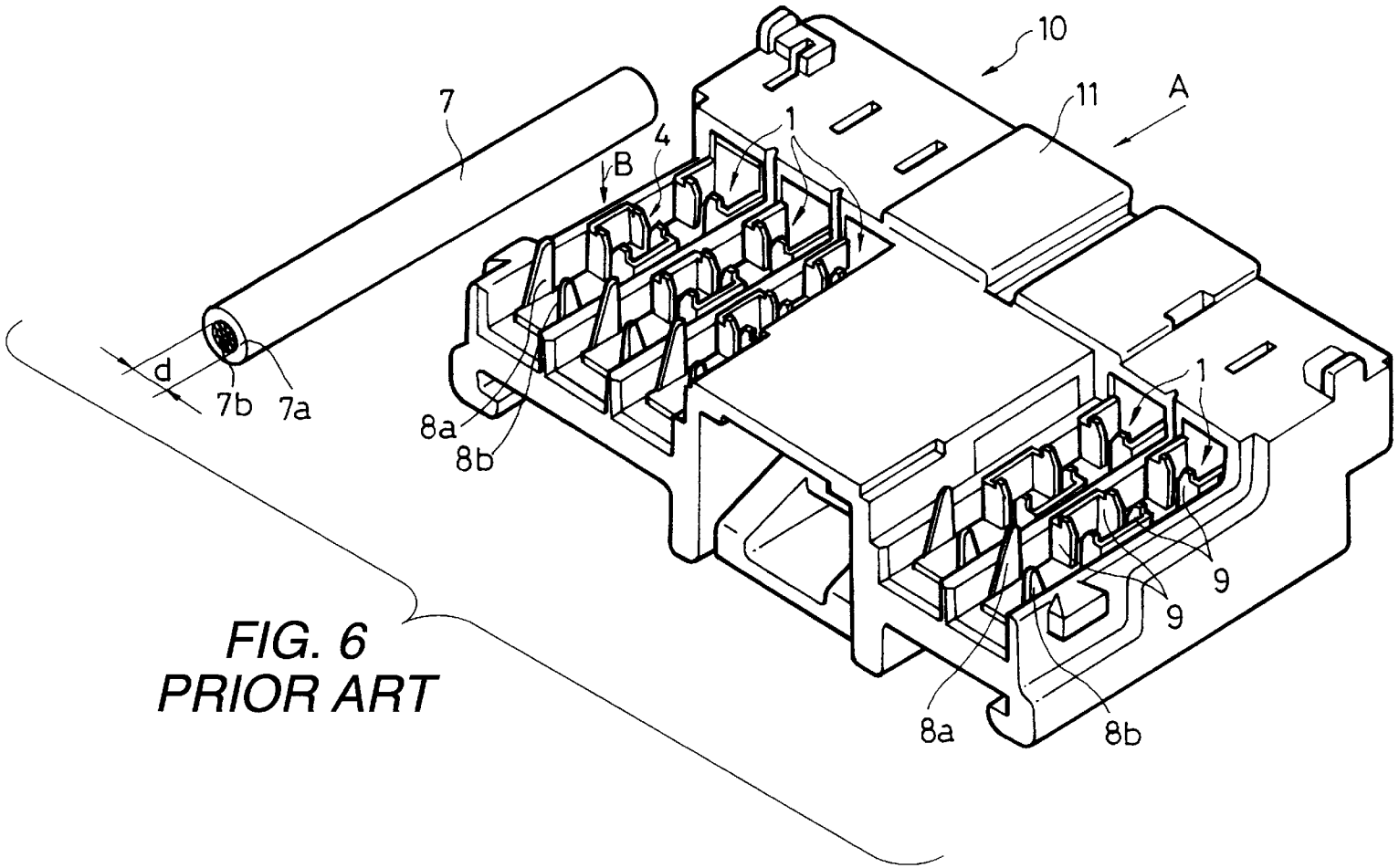
FIG. 6 PRIOR ART
FIG. 6 is a perspective view of an important portion of a conventional press-fitting connector.
Figure 7:
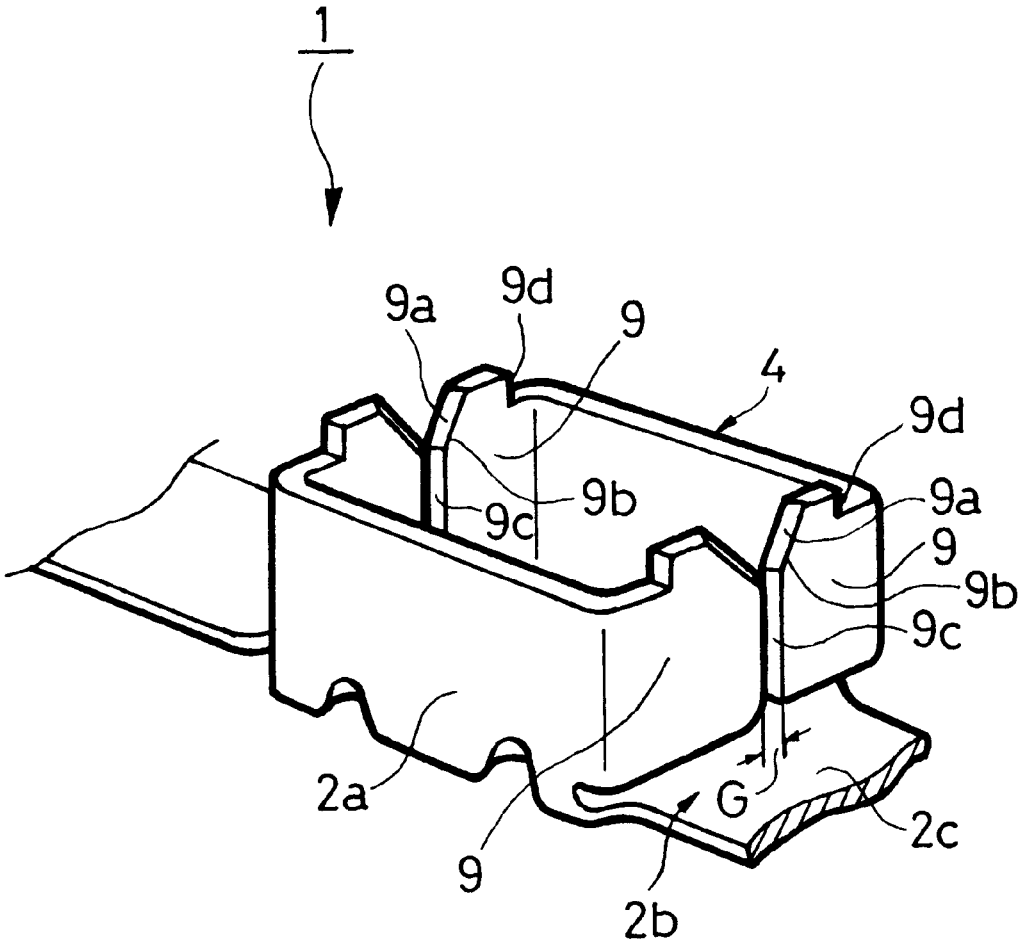
FIG. 7 PRIOR ART
FIG. 7 is a fragmentary, perspective view of a conventional press-connecting terminal, showing a press-connection portion and its surrounding portions.
Figure 8:
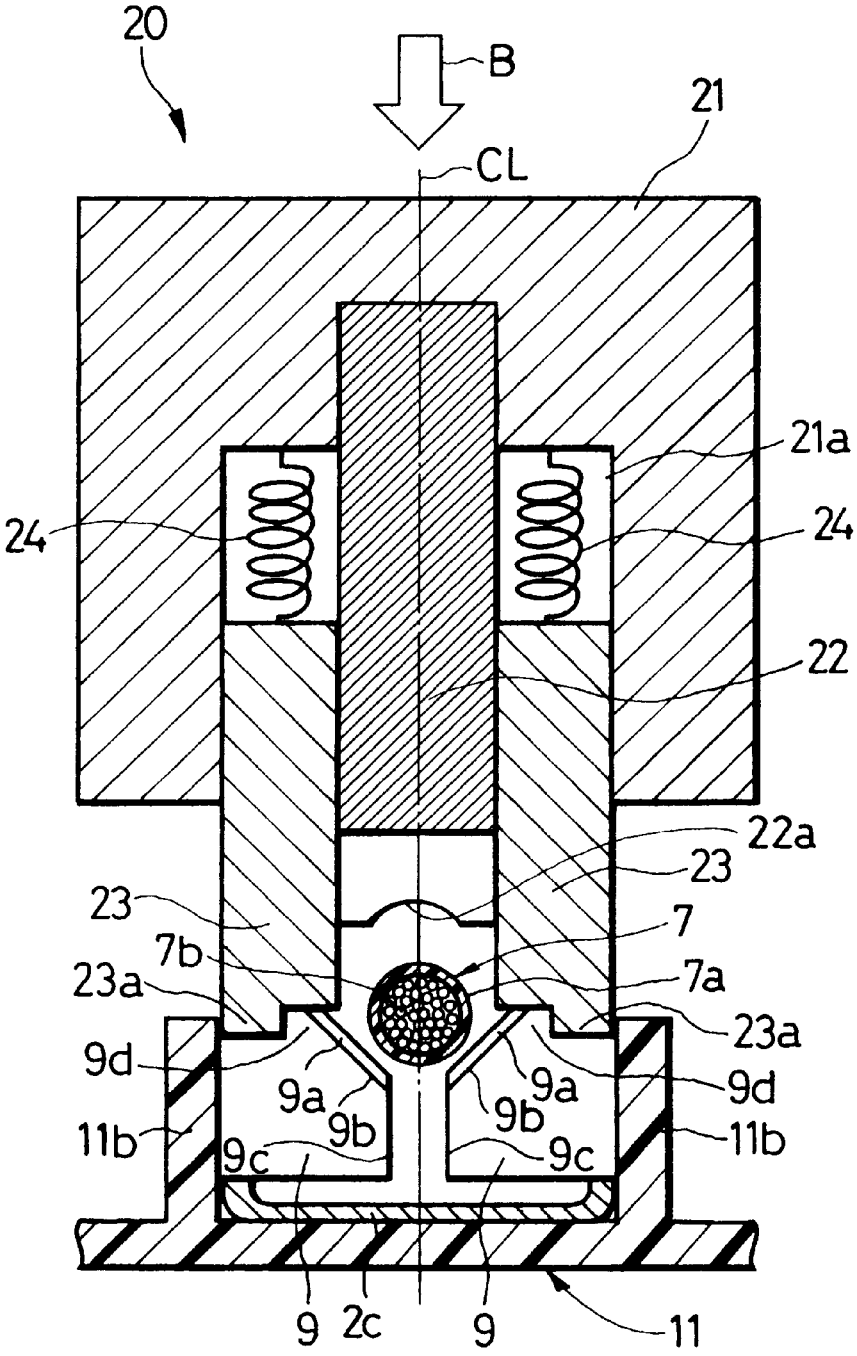
FIG. 8 PRIOR ART
FIG. 8 is an operation-explaining view of a conventional wire press-fitting apparatus.
Figure 9:
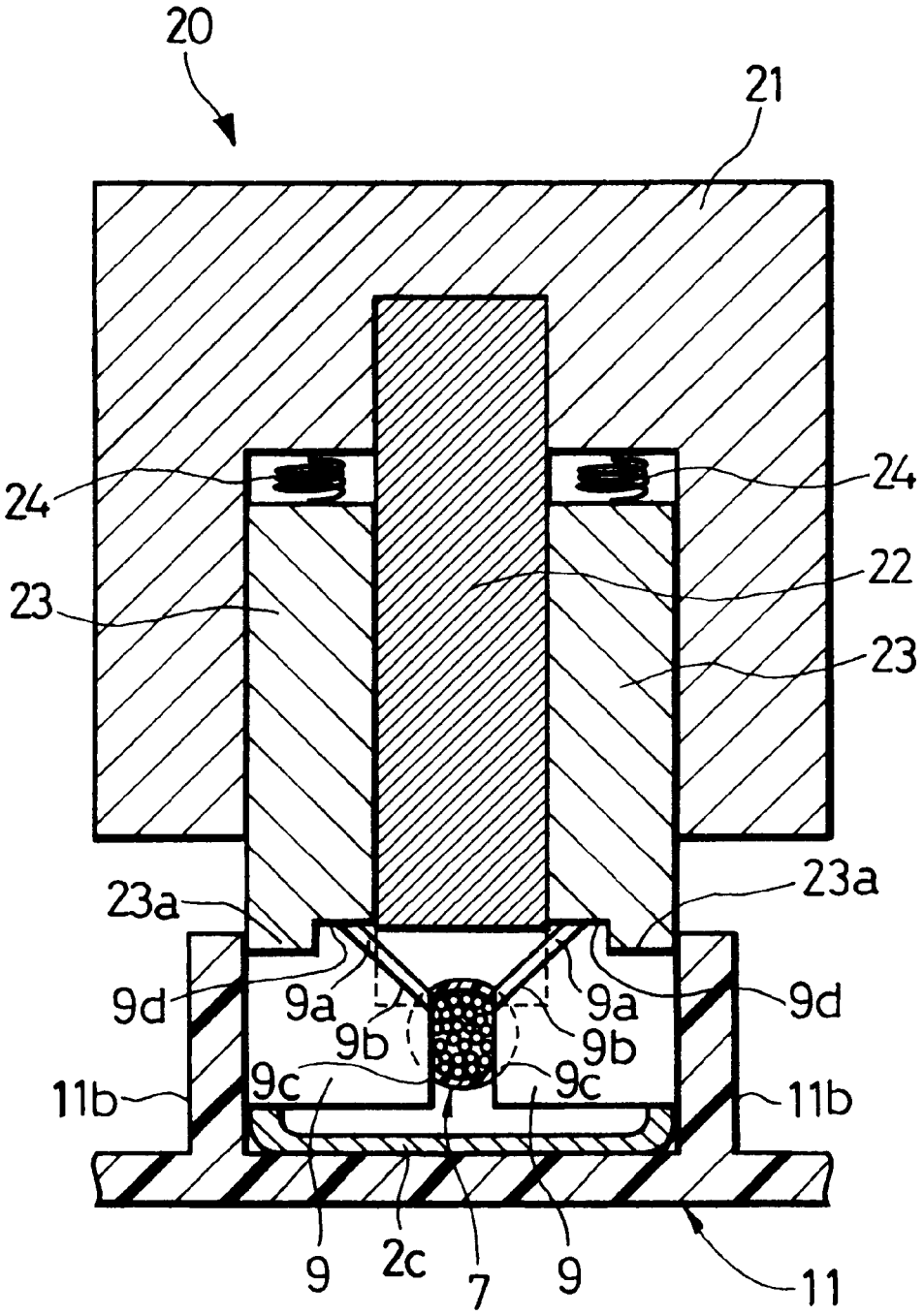
FIG. 9 PRIOR ART
FIG. 9 is an operation-explaining view showing a condition in which a wire press-fitting operation in FIG. 8 is completed.

One preferred embodiment of a press-connecting connector of the present invention, as well as a wire press-fitting apparatus of the present invention, will now be described in detail with reference to FIGS. 1 to 5. FIG. 1 is a fragmentary, cross-sectional view of an important portion of the press-connecting connector of this embodiment, FIG. 2 is an operation-explaining view of the wire press-fitting apparatus of this embodiment, FIG. 3 is a an operation-explaining view showing an initial stage of a wire press-fitting operation effected by the wire press-fitting apparatus of FIG. 2, FIG. 4 is an operation-explaining view showing an intermediate stage of the wire press-fitting operation in FIG. 3, and FIG. 5 is an operation-explaining view showing a condition in which the wire press-fitting operation in FIG. 4 is completed. Those portions, identical in construction to those of the conventional connector housing and the conventional press-connecting terminal, will be designated by identical reference numerals, respectively, and detailed description thereof will be omitted.

As shown in FIG. 1, the press-connecting connector 30 of this embodiment comprises a connector housing 31 and press-connecting terminals 1. The press-connecting terminal 1 is formed by cutting and bending an electrically-conductive metal sheet, and this press-connecting terminal 1 broadly includes a connection portion 3 and a press-connecting portion 4. The connection portion 3 can be electrically connected to a connection terminal (not shown) in a mating connector, and an insertion port 5 for receiving the connection terminal in the mating connector is formed adjacent to a front end of the connection portion 3.

A feature of the press-connecting connector 30 resides in the fact that a receiving width W2 between opposed side walls 31*b* and 31*b* of each terminal receiving chamber 31*a* for receiving the press-connecting portion 4 of the press-connecting terminal 1 is larger than a width W1 of the press-connecting portion 4. Namely, a gap g is formed between an outer surface (outer end) of each of press-connecting blades 9, received in the terminal receiving chamber 31*a*, and the surface of the corresponding side wall 31*b*, and this gap g allows the whole of the press-connecting blade 9 to be displaced toward the corresponding side wall 31*b*during the wire press-fitting operation.

As shown in FIG. 2, the wire press-fitting apparatus 40 of this embodiment comprises a vertically-movable hollow body portion 41, a press-fitting rod portion 42 which can project downwardly along an axis CL of the hollow body portion 41, and a pair of press-connecting blade pressing portions 43 resiliently suspended in an internal space 41*a* of the hollow body portion 41 through spring members 44. A feature of this wire press-fitting apparatus 40 resides in the fact that a lower end surface 43*a* of each of the press-connecting blade pressing portions 43 for pressing upper end surfaces 9*d* of the press-connecting blades 9 is formed into a flat surface.

Next, the wire press-fitting operation, effected for the press-connecting connector of this embodiment by the wire press-fitting apparatus, will be described with reference to FIGS. 2 to 5.

In the process of moving the hollow body portion 41 downward to a lower limit in the wire press-fitting apparatus 40, first, the flat lower end surfaces 43*a* of the press-connecting blade pressing portions 43 are resiliently pressed respectively against inner portions of the stepped upper end surfaces 9*d* disposed adjacent respectively to bladed, tapering guide surfaces 9*a*, as shown in FIG. 2. Then, a lower end 42*a* of the press-fitting rod 42 forces an electric wire 7 into a gap G between opposed, downwardly-extending inner surfaces 9*c* and 9*c* via the bladed, tapering guide surfaces 9*a*, as shown in FIG. 3.

When the electric wire 7 is gradually forced into the gap G between the opposed, downwardly-extending inner surfaces 9*c* and 9*c* via the bladed, the press-connecting blades 9 receive the force of downward movement of the electric wire 7, and slightly push the lower end surfaces 43*a* of the press-connecting blade pressing portions 43 back upwardly through the upper end surfaces 9*d*, as shown in FIG. 4. At this time, the pair of press-connecting blades 9, received in the terminal receiving chamber 31*a* (see FIG. 1), are displaced away from each other respectively toward the opposed side walls 31*b* of the connector housing 31 because of the provision of the gap g between the outer surface of each press-connecting blade 9 and the inner surface of the corresponding side wall 31*b*.

As a result, the gap G is expanded into a generally V-shape in accordance with the outer diameter of the electric wire 7 press-fitted thereinto, and a sheath 7*a* of the press-fitted wire 7 is cut by edges 9*b* of the pair of press-connecting blades 9 while the outer diameter of this wire 7 is gradually compressed and deformed along the pair of bladed, tapering guide surfaces 9*a*. Then, when the electric wire 7 is further press-fitted, the sheath 7*a* is cut as shown in FIG. 5.

As described above, in the press-connecting connector and the wire press-fitting apparatus of this embodiment, the lower end surfaces 43*a* of the press-connecting blade pressing portions 43 are flat, and besides the gap g is formed between the outer surface of each press-connecting blade 9 and the corresponding side wall 31*b* so that the pair of press-connecting blades 9 can be displaced away from each other respectively toward the opposed side walls 31*b* of the connector housing 31.

Therefore, even if there are variations in thickness of the sheath 7*a* and diameter of a conductor 7*b*, the pair of press-connecting blades 9 can be displaced away from each other respectively toward the opposed side walls 31*b* in accordance with the outer diameter of the electric wire 7 when the electric wire 7 is forced into the gap G via the bladed, tapering guide surfaces 9*a*, and therefore the edges 9*b* properly cut the sheath 7*a* without excessively cutting the conductor 7*b*.

In the press-connecting connector 30 of the present invention, the angle and length of inclination of the bladed, tapering guide surfaces 9*a*, the length of the edges 9*b*, the gap G between the opposed, downwardly-extending inner surfaces 9*c* and 9*c* can be changed in accordance with the thickness of the sheath 7*a* and the diameter of the conductor 7*b* so that the deformation, cutting, press-contact, holding and electrical connection of the electric wire 7 by the press-connecting blades 9 can be suitably adjusted.

Although the wire press-fitting apparatus 40 of the present invention comprises three units each operable for one pair of press-connecting blades 9 and 9, the hollow body portions 41, the press-fitting rod portions 42, the spring members 44, and the press-connecting blades pressing portions 43 of the three units can be formed into a single unit operable for the three pairs of press-connecting blades 9.

A hydraulic, a pneumatic or an electric actuator, a crank press device or a toggle press device can be used as a drive device for moving the hollow body portion 41 upward and downward. A coil spring, a leaf spring or an elastic member of rubber or other material can be used as the spring members 44.

In the press-connecting connector of the present invention, the pair of press-connecting blades include the respective bladed, tapering guide surfaces each slanting inwardly downwardly, and the respective opposed inner surfaces which extend downwardly respectively from the bladed, tapering guide surfaces, with the gap formed therebetween, the gap being smaller than the diameter of the conductor of the electric wire, and the receiving width between the opposed side walls of the connector housing, receiving the press-connecting portion, is larger than the width of the press-connecting portion so that the pair of press-connecting blades can be tilted respectively toward the opposed side walls in accordance with the press-fitting of the electric wire, so that the gap between the opposed, downwardly-extending inner surfaces is expanded into a generally V-shape.

Therefore, the degree of displacement of the press-connecting blades respectively toward the opposed side walls can vary in accordance with the outer diameter of the electric wire, and the edges, formed respectively along the bladed, tapering guide surfaces, can properly cut the sheath of the electric wire without excessively cutting the conductor. Therefore, the degree of press-contact of the conductor with the opposed, downwardly-extending inner surfaces can be kept good, depending on the press-fitted wire, and an electrical resistance at the area of contact between the conductor and each downwardly-extending inner surface decreases to generate less heat, so that those members around the press-connecting portion are prevented from deterioration, improper contact and so on. Therefore, there can be obtained the press-connecting connector of high reliability.

In the wire press-fitting apparatus of the present invention, each of the pair of press-connecting blade pressing portions has the flat lower end surface for pressing the upper end surface of the corresponding press-connecting blade of the press-connecting blade, and in accordance with the press-fitting of the electric wire, the pair of press-connecting blades slightly push the lower end surfaces of the press-connecting blade pressing portions back upwardly through the upper end surfaces, so that the pair of press-connecting blades are tilted respectively toward the opposed side walls of the connector housing with the result that the gap between the opposed, downwardly-extending inner surfaces of the press-connecting blades is expanded into a generally V-shape.

Therefore, the edges, formed respectively along the bladed, tapering guide surfaces, can properly cut the sheath of the electric wire without excessively cutting the conductor.

What is claimed is:

1. A press-connecting connector, comprising:

a connector housing including a terminal receiving chamber defined between opposed side walls; and a press-connecting terminal insertable into the terminal receiving chamber, the press-connecting terminal including:

a connection portion, to which a terminal of a mating connector is electrically connectable, and a press-connecting portion, to which a conductor of an electric wire is electrically connectable, the press-connecting portion including a pair of press-connecting blades which have:

a pair of bladed, tapering guide surfaces which slant inwardly downwardly, and a pair of opposed inner surfaces, between which a gap smaller than a diameter of the conductor of the electric wire is formed, and which downwardly extend respectively from the pair of tapering guide surfaces;

wherein when the electric wire is press-fitted into the gap, the conductor of the electric wire is electrically connected to and held by the pair of press-connecting blades, wherein a receiving width between the opposed side walls of the terminal receiving chamber receiving the press-connecting portion is larger than a width of the press-connecting portion, wherein the pair of press-connecting blades are tilted respectively toward the opposed side walls when the electric wire is press-fitted into the gap, so that the opposed inner surfaces of the press-connecting blades are outwardly expanded into a generally V-shape, and such that the corresponding side walls of the terminal receiving chamber remain rigid.

2. A press-connecting system for forming an electrical connection onto an electric wire, comprising:

a connector to which the electric wire is to be connected, the connector including:

a housing including a terminal receiving chamber defined between opposed side walls; and a press-connecting portion, disposed in a chamber to make contact with the electric wire to which a conductor of the electric wire is electrically connectable, the press-connecting portion including a pair of press-connecting blades which have:

a pair of bladed, tapering guide surfaces which slant inwardly downwardly, and a pair of opposed inner surfaces, between which a gap smaller than a diameter of the conductor of the electric wire is formed, and which downwardly extend respectively from the pair of tapering guide surfaces; and a wire press fitting apparatus including:

a hollow body portion which is vertically moveable;

a press-fitting rod portion which can project downwardly along an axis of the hollow body portion; and a pair of pressing portions, which are operative to press a pair of press-connecting blades of the press-fitting portion of the press-fitting terminal, and which are resiliently suspended in an internal space of the hollow body portion through spring members;

wherein each of the pair of pressing portions has a lower end surface for pressing an upper end surface of the corresponding press-connecting blade, wherein the lower end surface of each of a pair of pressing portions is defined by a level plane; and wherein the lower end surfaces of the pressing portions can be slightly pushed back upwardly through the upper end surfaces when said press-fit rod portion presses the electrical wire into a gap between a pair of opposed inner surfaces of the pair of press-connecting blades, so that the pair of press-connecting blades are tilted respectively toward opposed side walls of a connector housing with a result that opposed inner surfaces of the press-connecting blades are outwardly expanded into a generally V-shape, and such that the corresponding side walls of the terminal receiving chamber remain rigid.

* * * * *